US012137788B2

(12) United States Patent
Kim et al.

(10) Patent No.: US 12,137,788 B2
(45) Date of Patent: Nov. 12, 2024

(54) DEVICE FOR PACKAGING AND DISPENSING A PRODUCT HAVING INCLINED ELASTICALLY DEFORMABLE TEETH

(71) Applicant: L'Oreal, Paris (FR)

(72) Inventors: Jin Seok Kim, Shanghai (CN); Vincent Jacquart, Shanghai (CN); Venkatesh Sheregar, Shanghai (CN)

(73) Assignee: L'Oreal, Paris (FR)

( * ) Notice: Subject to any disclaimer, the term of this patent is extended or adjusted under 35 U.S.C. 154(b) by 590 days.

(21) Appl. No.: 17/292,344

(22) PCT Filed: Nov. 7, 2018

(86) PCT No.: PCT/CN2018/114411
§ 371 (c)(1),
(2) Date: May 7, 2021

(87) PCT Pub. No.: WO2020/093282
PCT Pub. Date: May 14, 2020

(65) Prior Publication Data

US 2022/0000243 A1 Jan. 6, 2022

(51) Int. Cl.
*A45D 34/04* (2006.01)
*A45D 19/02* (2006.01)
(Continued)

(52) U.S. Cl.
CPC ..... *A45D 34/04* (2013.01); *A45D 19/026* (2021.01); *A45D 40/24* (2013.01); *B65D 47/42* (2013.01);
(Continued)

(58) Field of Classification Search
CPC ..... A45D 34/04; A45D 19/026; A45D 40/24; A45D 2200/058; A45D 34/045;
(Continued)

(56) References Cited

U.S. PATENT DOCUMENTS 5,862,818 A * 1/1999 Marinelli ..... B65D 51/32 206/229
8,728,414 B2 * 5/2014 Beach ..... A61B 10/02 422/549
2006/0216105 A1 * 9/2006 Byun ..... A46B 11/0041 401/270
(Continued)

FOREIGN PATENT DOCUMENTS

EP 2 580 985 A1 4/2013
JP 2006-232323 A 9/2006
(Continued)

OTHER PUBLICATIONS

International Search Report mailed May 24, 2019, issued in corresponding International Application No. PCT/CN2018/114411, filed Nov. 7, 2018, 3 pages.

*Primary Examiner* — Vishal Pancholi
(74) *Attorney, Agent, or Firm* — Christensen O'Connor Johnson Kindness PLLC

(57) ABSTRACT

Device (10) for packaging at least one product and dispensing at least said product on a surface and comprising at least one container (14) delimiting a product cavity (24*a*) containing said at least one product and having a dispensing closure (26) designed to be separated from the container (14) for first use of said device in order to open a first dispensing orifice (24*b*) in flow communication with the product cavity (24*a*). Said device comprises an application member (40) mounted on the at least one container (14) having at least two rows (44*b*, 44*d*) of elastically deformable application teeth (44) arranged on both side of the dispensing closure (26) and extending outwardly from said at least one container (14), said application teeth (44) being each inclined towards the longitudinal axis (X-X') of the first dispensing orifice (24*b*), and at least a plurality of teeth of the said rows (44*b*, 44*d*) of teeth are deformed in a stressed position by the
(Continued)

contact with the dispensing closure (26) and configured to return elastically in a rest position when the dispensing closure (26) is removed, in said rest position, the teeth are more inclined towards the longitudinal axis (X-X') of the first dispensing orifice (24*b*) then in the stressed position.

15 Claims, 6 Drawing Sheets

(51) Int. Cl.
*A45D 40/24* (2006.01)
*B65D 47/42* (2006.01)
*B65D 81/32* (2006.01)

(52) U.S. Cl.
CPC .... *B65D 81/3211* (2013.01); *A45D 2200/058* (2013.01)

(58) Field of Classification Search
CPC .... B65D 47/42; B65D 81/3211; B65D 51/32; B65D 51/2878
See application file for complete search history.

(56) References Cited

U.S. PATENT DOCUMENTS

| | | | | |
|---|---|---|---|---|
| 2008/0142032 | A1 | 6/2008 | Liberty et al. | |
| 2011/0041863 | A1 | 2/2011 | Roualdes | |
| 2011/0220138 | A1 | 9/2011 | Roberts et al. | |
| 2013/0174860 | A1* | 7/2013 | Takagi | A45D 34/042 132/200 |
| 2017/0057705 | A1* | 3/2017 | Bailey | B65D 51/002 |

FOREIGN PATENT DOCUMENTS

| | | | |
|---|---|---|---|
| KR | 10-0626174 | B1 | 9/2006 |
| KR | 10-1139183 | B1 | 4/2012 |

* cited by examiner

DEVICE FOR PACKAGING AND DISPENSING A PRODUCT HAVING INCLINED ELASTICALLY DEFORMABLE TEETH

The present invention relates to the general field of containers for packaging and dispensing a liquid or semi-liquid product such as, a cosmetic product such as a hair product, and more particularly to hair-care product such as hair serum, hair coloring, hair oil, cream hair, or to product used for washing such as body wash, or to skin care product such as body or face cream, cleansing product or to any product used for hair-care or skin-care.

More particularly, the invention relates to a packaging and dispensing container having a plurality of comb teeth designed to apply a product on a surface.

One advantageous application of the invention is the use of the container for packaging cosmetic products, such as cosmetic products for dyeing human keratin fibers. Other advantageous applications of the invention may be the use of the container to store care products, adhesive products, polymer coatings, flavored liquids, etc.

The expression "cosmetic product" is understood to mean a product as defined in Article 2 of Regulation No. 1223/2009 of the European Parliament and of the Council of 30 Nov. 2009.

One aim of the present invention is to provide a device for packaging at least one product of simple structure, easy to manufacture and allowing a good retention and distribution of said product on a surface.

The object of the present invention is to provide a device for packaging at least one product and dispensing at least said product on a surface, for example hair. Said device comprises at least one container delimiting a product cavity containing said at least one product and having a dispensing closure, for example a frangible end piece, designed to be separated from the container for first use of said device in order to open a first dispensing orifice in flow communication with the product cavity.

Said device comprises an application member mounted on the at least one container having at least two rows of elastically deformable application teeth arranged on both side of the dispensing closure and extending outwardly from said at least one container, said application teeth being each inclined towards the longitudinal axis of the first dispensing orifice. The application teeth are thus towards the flow path of the product to be dispensed.

At least a plurality of teeth of the two rows of teeth are deformed in a stressed position by the contact with the dispensing closure and are configured to return elastically in a second position which correspond to the rest position of the teeth when the dispensing closure is removed.

In the rest position, the teeth are more inclined towards the longitudinal axis of the first dispensing orifice than in the stressed position.

In other words, the teeth are thus capable, from the material used and/or their dimension, to be deformed under a slight solicitation, for example by the dispensing closure, or by the user during the application on an application surface such as the hair, and to return to their initial position when no solicitation is exerted on the teeth.

Elastically deformable inclined teeth allow good retention and restitution of the product to be dispensed. Indeed, the distribution of the product is easily controlled by the inclined teeth.

During transport and before the first use, when the dispensing closure is located between the teeth, the teeth are deformed in the stressed position in which the teeth in contact with the dispensing closure form a first angle with the longitudinal axis.

In the rest position, the teeth form a second angle with the longitudinal axis. The second angle is bigger than the first angle.

Advantageously, the application teeth extend transversally beyond the first dispensing orifice.

The teeth may have the shape of a straight rod.

For example, the free ends of the teeth are not in contact in the rest position.

Advantageously, the application member comprises a cover having an opening for the dispensing closure.

Each tooth may have a base section connected to the cover and a free end opposite to the base section and wherein each tooth is capable of flexing around the junction with its base section and the cover.

For example, the application member comprises four rows of teeth arranged two by two on each side of the dispensing closure.

The rows of teeth may be parallel to each other.

Advantageously, the teeth of two adjacent rows of teeth are in a staggered arrangement, in such a way that when the four rows are pushed towards the central axis of the device, their free ends only form two rows of teeth. In other words, when the rows of teeth are brought towards the central axis of the device, the free end of teeth of a first row fit between the free ends of teeth of the second row and the free ends of teeth of a third row fit between the free ends of teeth of the fourth row.

The staggered arrangement of the teeth allows a zig-zag distribution of the product to be dispensed.

Each tooth may have a triangular cross section, which may decrease continuously, on at least a part of its length, towards its free end.

The teeth may be made in a flexible deformable and capable of bouncing back material, such as a thermoplastic, for example a low-density polyethylene (LDPE), a high-density polyethylene (HDPE), a thermoplastic elastomer (TPE), a thermoplastic polyurethane (TPU) or any material capable of being elastically deformed.

The cover may be made in a thermoplastic polymer, such as polypropylene (PP), acrylonitrile butadiene styrene (ABS), polyethylene terephthalate (PET), Nylon or any material stiffer than the teeth.

Advantageously, the end of the container is provided with notches in order to easily separate the dispensing closure from said container.

The notches may be located circumferentially around the end of the container and spaced apart from each other. Alternatively, a single notch may be provided around the end of the container.

According to an embodiment, the dispensing closure comprises a plug opposite to the notches designed to be inserted in the dispensing orifice after the dispensing closure is broke off from the duct. The dispensing closure is thus repositionable and may close the dispensing orifice after use.

In an embodiment, the device comprises a second container delimiting a second product cavity containing a second product and separated from the first product cavity, said containers being capable of rotating one relative to the other without moving axially.

Advantageously, said device further comprises a temporary closing member configured to close an opened end of the upper container before the first use, and comprising a cylindrical skirt surrounding said opened end and a plug connected to said cylindrical skirt, said cylindrical skirt being provided, on its inner cylindrical surface, with inner threads cooperating with outer threads provided on the upper container and on its outer cylindrical surface, with first anti-rotation means cooperating with second anti-rotation means provided on the lower container for preventing rotation between the closing member and the lower container. The closing member is deprived from any axially retaining members with both containers, such that when the upper container is rotated in a first rotation direction, the closing member translates downwardly until falling into the first product cavity.

The present invention will be better understood from studying the detailed description of an embodiment considered by way of a non-limiting example and illustrated by the attached drawings in which:

FIGS. 1 to 11 show an example of a device for packaging two products separately and dispensing a mixture M of those two products on first use, denoted by the general reference number 10.

Figure 1:
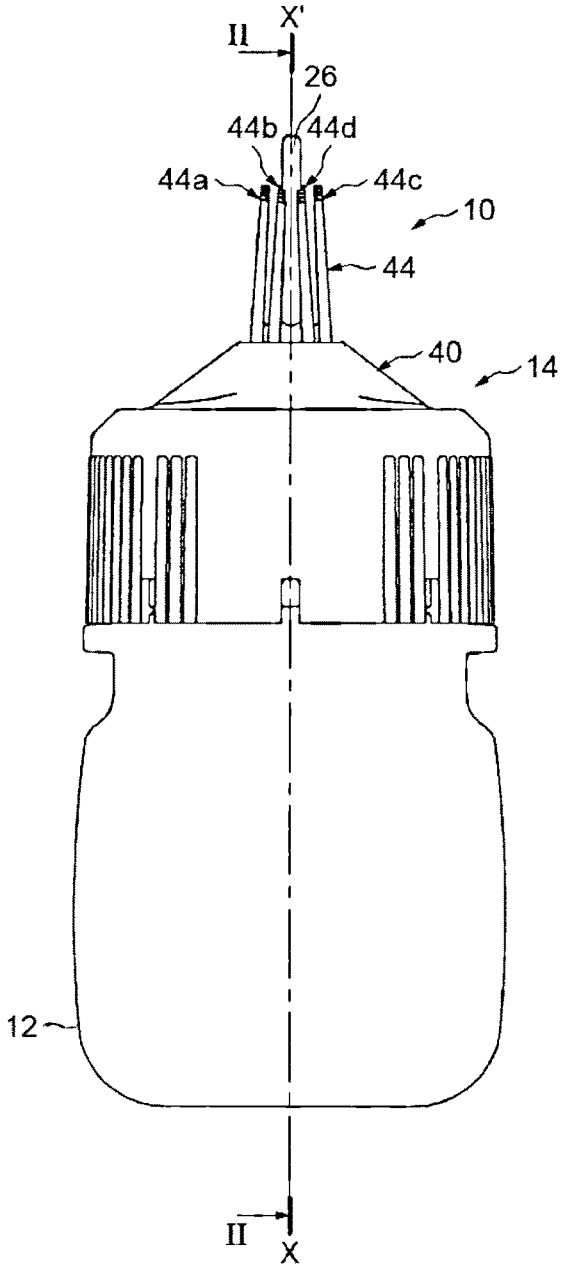
FIG. 1 is a front view of a device according to a first embodiment of the present invention.

The device 10 may be used for packaging two cosmetic products A and B, for example two liquid or semi-liquid cosmetic products, or a liquid product and a powder. For example, the products may be hair products, such as, hair-care products, for example, hair dye, cream hair or the any product used for hair. However, it might be possible to provide the packaging and dispensing of other types of products. The device 10 is suited for one application products. By way of example, the first product A is an oxidative colorant and the second product is an oxidant agent B which when mixed together to make a mixture M forms a hair dye.

The device 10 may also be used for packaging other types of cosmetics products such as skin care products, or other types of products like food products, such as flavoured liquids, or any products that may be kept separated during transport and storage, such as adhesive products, polymer coatings, etc.

However, the device 10 may also be used for packaging and dispensing only one single product.

The device 10 extends along a longitudinal axis X-X' assumed to be vertical on the Figures. The device 10 comprises a lower container 12 and an upper container 14 that are capable of turning one relative to the other about said longitudinal axis X-X'.

When used to package and dispense only one product, the device may comprise only the upper container 14 and not the lower container 12, or the both containers, but the upper container act like a dispensing member.

The lower container 12 has the shape of a bottle having an elongated body along the longitudinal axis provided with a closed lower end 16 forming a bottom and an upper end 18 forming a neck provided with an opening 20, opposite the lower end 16, allowing access to the internal cavity 22 containing the first product A.

In the embodiment illustrated, the neck 18 has an outer diameter smaller than the outer diameter of the body of the lower container 12 and comprises, on its outer surface, two outer annular shoulders 18*a* delimiting an annular groove 18*b*. The body of the lower container 12 may be made, for example, of rigid plastic material.

The upper container 14 is in the form of a cap and comprises a central dispensing chimney or duct 24 containing the second product B having an upper portion shaped with a dispensing closure 26 and a lower end provided with an opening 28, opposite to the dispensing closure 26, and allowing access to au internal cavity 24*a* of the duct 24 containing the second product B.

The dispensing closure 26 is designed to be broken for first use in order to open a dispensing orifice 24*b* in flow communication with the internal cavity 24*a*.

In the embodiments shown on FIGS. 1 to 10, the dispensing closure 26 is frangible. Alternatively, the dispensing closure 26 may be unscrewed or teared off or pealed from the duct 24.

As illustrated, the end of the duct 24 is provided with notches 26*a* in order to easily separate the dispensing closure 26 from the duct 24. A plurality of notches 26*a* may be located circumferentially around the duct 24 and spaced apart from each other. Alternatively, a single notch 26*a* may be provided around the duct 24.

The dispensing closure 26 may be provided with a plug (not shown) opposite to the notches 26*a* designed to be inserted in the dispensing orifice 24*b* after the dispensing closure 26 is broke off from the duct 24. The dispensing closure 26 is thus repositionable and may close the dispensing orifice after use.

The dispensing duct 24 is surrounded by an assembly skirt 30 provided on its radially inner surface with an annular bead 30*a* cooperating with the annular groove 18*b* of the lower container 12 by snap-fit attachment, such that the upper container 14 is held axially relative to the lower container 12, while allowing a rotating movement one relative to the other.

The upper container 14 has an annular sealing lip 32 extending substantially along the longitudinal axis X-X' down into an annular channel 14*a* formed between the dispensing chimney 24 and the assembly skirt 30. The sealing lip 32 is annular and bears closely against the radially inside surface of a portion 18*c* of the neck 18, which surface is annular, thereby providing sealing between the lower container 12 and the upper container 14.

Advantageously, the annular sealing lip 32 of the upper container 14 is configured to be elastically deformed in the radial direction against the sealing portion 18*c* of the neck 18 when inserting the dispensing duct 24 of the upper container 14 in the neck 18 of the lower container 12.

In particular, the sealing portion 18*c* of the neck 18 comprises a slope extending inwardly in the radial direction from an upper portion 18*d* of the neck, this slope assisting the elastic deformation of the annular sealing lip 32 of the upper container 14 when this latter is assembled on the lower container 12.

Advantageously, the upper portion 18*d* of the neck 18 of the lower container 12 has an inner diameter that is bigger than the outer diameter of the annular sealing lip 32 of the upper container 14. Therefore, the risk that the opened end of the neck 18 of the lower container 12 and the annular sealing lip 32 be damaged by mutual contact when the upper container 14 is assembled on the lower container 12 is lowered.

The sealing portion 18*c* is located axially away from the opened end of the neck 18 and is thus not subjected to degradation when the lower container is carried by its neck and/or when the upper container 14 is assembled on the lower container 12.

The sealing portion 18*c* has a C-shape in cross section, which allows said sealing portion 18*c* to be elastically deformed when inserting the dispensing chimney 24 of the upper container 14 in the neck 18 of the lower container 12. Such a particular shape increases radial interference between the sealing portion 18*c* and the sealing lip 32. The airtightness of the device 10 is thus increased.

The upper portion 18*d* of the neck 18 is configured to guide the upper container 14 until the assembly skirt 30 of the dispensing chimney 24 cooperates by snap-fit attachment with the lower container 12.

As illustrated, the upper container 14 further comprises an application member 40 mounted on the dispensing chimney 24 and comprising a cover 42 mounted on the upper end of the dispensing chimney 24 and a plurality of application teeth 44 extending outwardly from said cover 42.

The cover 42 comprises an opening 42*a* for the dispensing closure 26.

As a non-limiting example, the application member 40 comprises four rows 44*a*, 44*b*, 44*c*, 44*d* of application teeth 44 each inclined towards the flow path of the product to be dispensed.

Alternatively, the application member 40 may comprise only two rows of application teeth 44 or more than four.

All teeth 44 are inclined towards the central longitudinal axis X-X' of the device 10.

Each tooth 44 has a base section connected to the cover 42 and a free end opposite to the base section.

Each tooth 44 is elastically deformable and capable of flexing around the junction with its base section and the cover 42.

In other words, the teeth are thus capable, from the material used and/or their dimension, to be deformed under a slight solicitation, for example by the dispensing closure 26, or by the user during the application on an application surface such as the hair and/or the scalp, and to return to their initial position when no solicitation is exerted on the teeth.

Figure 2:
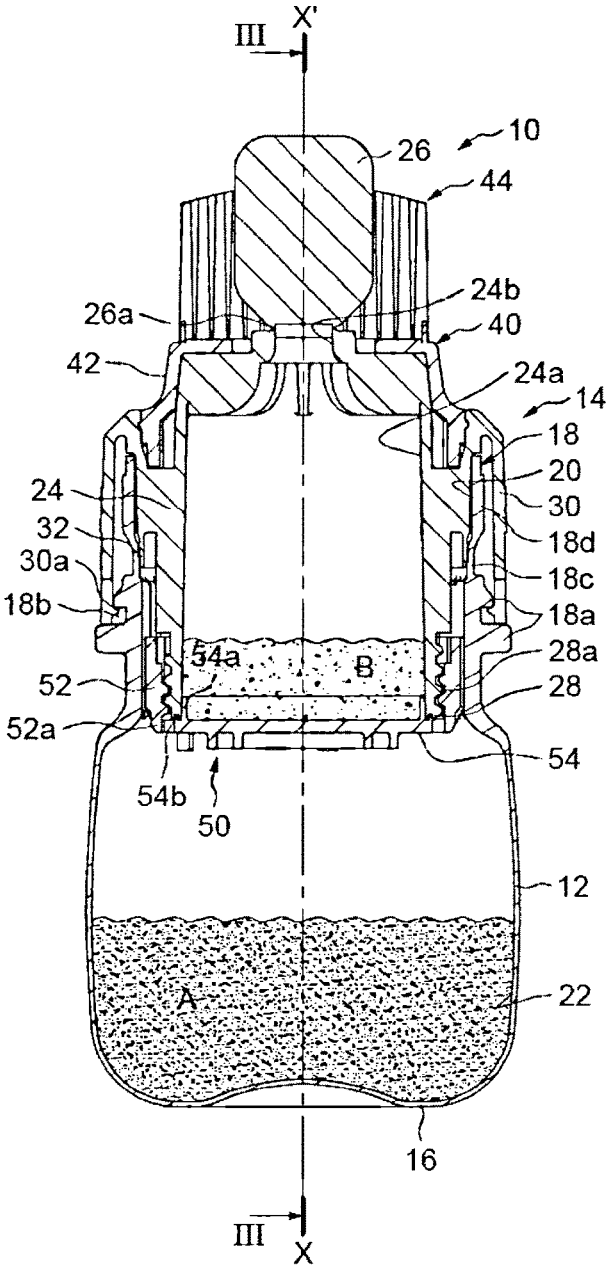
FIG. 2 is a cross section view along line II-II of the device of FIG. 1.
Figure 3:
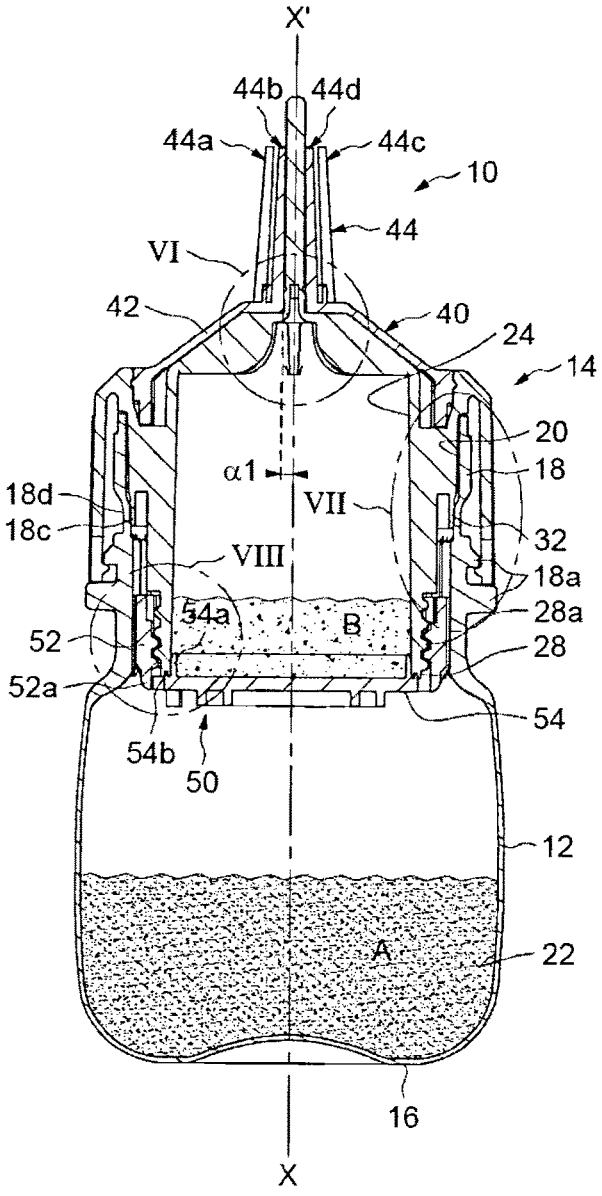
FIG. 3 is a cross view along line III-III of the device of FIG. 2.
Figure 4:
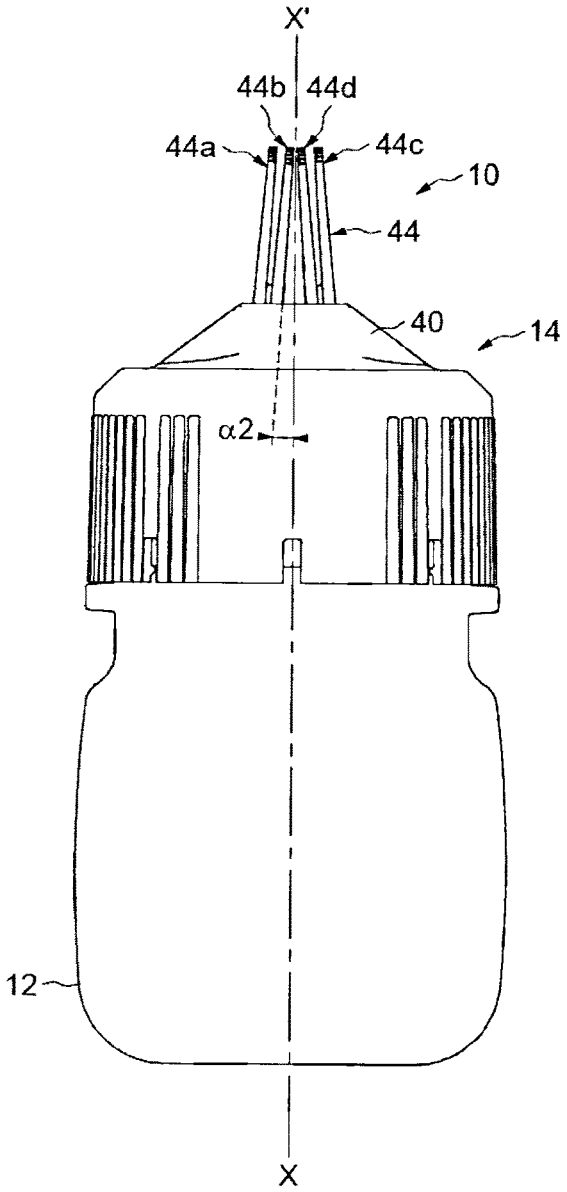
FIG. 4 is a front view of a device of FIG. 1, after removal of an end closure.

As illustrated in FIGS. 1 to 3, during transport and before the first use, the dispensing orifice 24*b* of the upper container 14 is closed off by the dispensing closure 26, which is located between the application teeth 44. The rows of the plurality of teeth 44 are thus arranged two by two on each side of the dispensing closure 26. The rows 44*a*, 44*b*, 44*c*, 44*d* of the plurality of teeth 44 are parallel to each other.

Figure 5:
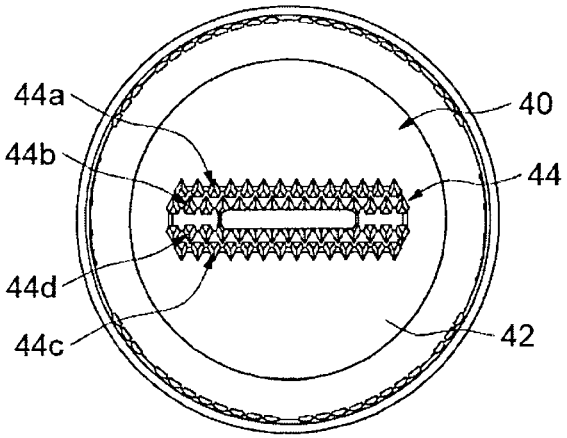
FIG. 5 is an upper view of the device of FIG. 4.
Figure 6:
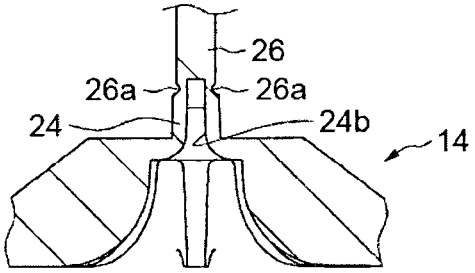
FIGS. 6 to 8 show details of the device of FIG. 1.
Figure 7:
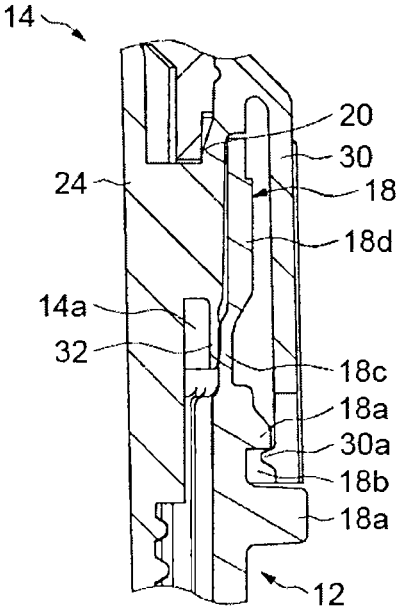
Figure 8:
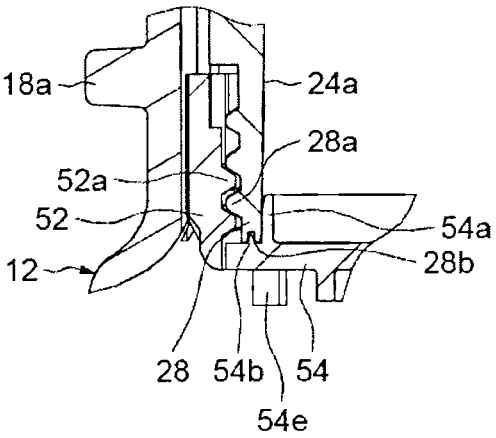

As illustrated on FIG. 5, the teeth 44 of two adjacent rows of teeth 44*a*, 44*b*; 44*c*, 44*d* are in a staggered arrangement, in such a way that when the four rows are pushed towards the axis X-X' of the dispensing orifice 24*b*, their free ends only form two rows of teeth 44. In other words, when the rows of teeth are brought towards the axis X-X' of the dispensing orifice 24*b*, the free ends of teeth 44 of a first row 44*a* fit between the free ends of teeth 44 of the second row 44*b* and the free ends of teeth 44 of a third row 44*c* fit between the free ends of teeth 44 of the fourth row 44*d*.

During transport and before the first use, when the dispensing closure 26 is located between the teeth 44, the teeth 44 of the second and the fourth rows 44*b*, 44*d* of teeth are stressed mechanically in a first position in which the teeth 44 in contact with the dispensing closure 26 form a first angle $\alpha 1$ with the longitudinal axis.

When the dispensing closure 26 is removed, the teeth 42 of the second and the fourth rows 44*b*, 44*d* of teeth that were in contact with the dispensing closure 26 are flexed automatically in a second position which correspond to the rest position of the teeth. In this rest position, the teeth of the second and the fourth rows 44*b*, 44*d* of teeth form a second angle $\alpha 2$ with the longitudinal axis. The second angle is bigger than the first angle.

In this rest position, the free end of the teeth of the second and the fourth rows 44*b*, 44*d* of teeth are in the flow path of the product to be dispensed.

Elastically deformable inclined teeth 44 allow good retention and restitution of the product to be dispensed. Indeed, the distribution of the product is easily controlled by the inclined teeth 44.

Furthermore, the staggered arrangement of the teeth 44 allows a zig-zag distribution of the product to be dispensed.

Each tooth 44 has a triangular cross section. The cross section of each tooth may decrease continuously, on at least a part of its length, towards its free end.

As illustrated, the application teeth extend transversally beyond the first dispensing orifice, and the teeth have the shape of a straight rod.

The free ends of the teeth are not in contact in the rest position.

The teeth 44 are made in a flexible deformable and capable of bouncing back material, such as a thermoplastic, for example a low-density polyethylene (LDPE), a high-density polyethylene (HDPE), a thermoplastic elastomer (TPE), a thermoplastic polyurethane (TPU) or any material capable of being elastically deformed.

The cover 42 and/or the upper container 14 may be made in a thermoplastic polymer, such as polypropylene (PP), acrylonitrile butadiene styrene (ABS), polyethylene terephthalate (PET), Nylon or any material stiffer than the teeth 44.

As illustrated in FIGS. 2 and 3, during transport and before the first use, a temporary closing member 50. In the example illustrated, the closing member 50 is a lid that is able to be screwed, in a sealed manner, onto an outer thread 28*a* provided on the outer surface of the lower end 28 of the dispensing chimney 24, between the dispensing chimney 24 and the inner surface of the neck 18.

The closing member 50 comprises a cylindrical skirt 52 and a plug 54 connected to said skirt 52. The cylindrical skirt 52 extends radially between the neck 18 of the lower container 12 and the lower end 28 of the dispensing chimney 24 of the upper container 14.

The cylindrical skirt 52 is provided on its inner cylindrical surface with inner threads 42*a* cooperating with the outer thread 28*a* of the dispensing chimney 24.

The cylindrical skirt 52 is further provided on its outer cylindrical surface with outer longitudinal ribs 52*b* regularly spaced apart on the whole circumference of the cylindrical skirt 52. Said outer longitudinal ribs 52*b* cooperate with inner longitudinal ribs 18*e* provided on the inner circumferential surface of the neck 18, such that the closing member 50 is prevented from rotating relative to the lower container 12.

As illustrated and in a non-limiting example, the outer longitudinal ribs 52*b* extend axially beyond the upper surface of the cylindrical skirt 52.

In the example shown, the outer diameter of the plug 54 is larger than the outer diameter of the opened end 28 of the dispensing chimney 24.

The cylindrical skirt 52 and the lower container 12 may be provided with anti-rotation means having a different shape than longitudinal ribs. Generally, the cylindrical skirt 52 and the lower container 12 are provided with anti-rotation means for preventing the closing member 50 front rotating relative to the lower container 12.

The upper surface of the plug 54 comprises a first annular sealing lip 54*a* axially extending towards the upper container 14 having an outer diameter substantially equal to the inner diameter of the lower opened end 28 of the dispensing chimney 24 in order to be inserted into said dispensing chimney 24 and to close it in a sealed manner.

The upper surface of the plug 54 comprises a second annular sealing lip 54*b* extending axially in an annular groove 28*b* provided at the end of the lower opened end 28.

Adding a second sealing lip increase airtightness of the upper container 14.

As illustrated, the second sealing lip 54*b* has an axial length smaller than the axial length of the first sealing lip 54*a*.

The plug 54 is connected by a bridge of hinge-forming material 54*c* and by links or bonds of breakable material 54*d* to the cylindrical skirt 52. In the embodiment shown on the Figures, there are seven links of breakable material 54*d* regularly spaced apart on the circumference of the plug 54. It could be possible to provide a number of breakable links 54*d* different than seven. For example, the plug 54 is connected to the cylindrical skirt 52 by a bridge of hinge-forming material 54*c* and by at least one breakable link 54*d*.

As shown, the plug 54 comprises a plurality of axially projecting bars or blocks 54*e* provided on the lower surface of the plug 54, opposite to the upper surface of the plug 54 having the annular sealing lips 54*a*. 54*b*. The axially projecting blocks 54*e* are disposed circumferentially on the lower surface of the plug 54 and are regularly spaced apart from each other.

Figure 9:
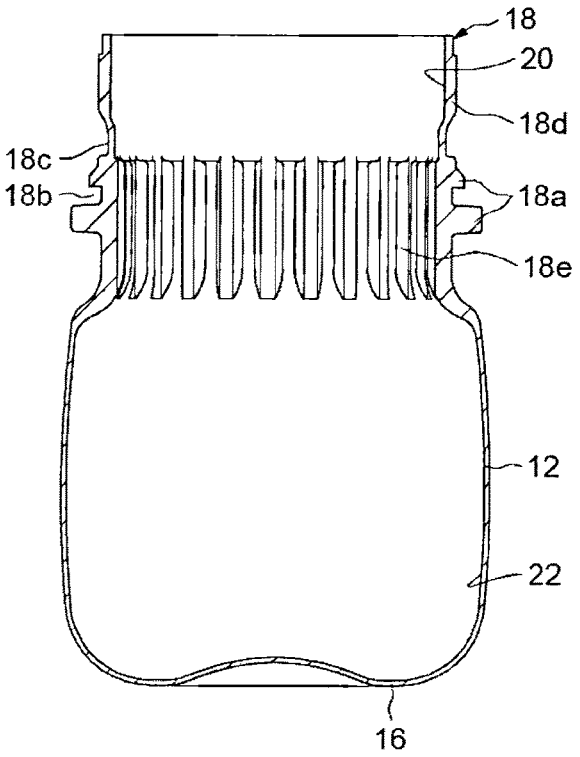
FIG. 9 is a cross view of a lower container of the device of FIG. 1, showing anti-rotation means.

As illustrated on FIG. 9, there are four blocks 44*e*. However, the number of blocks 54*e* is not limited to four and may be for example equal to one, two or three, or higher than four.

The blocks 54*e* are disposed on a diameter of the plug 54 substantially equal to the diameter of the dispensing chimney 24, so that when the closing member 50 is dropped in the lower container 12, the blocks 54*e* avoid obstructing the opened lower end 28 of the dispensing chimney 24.

It is also possible to provide a closing member without axially projecting blocks 54*e* and/or without breakable links 54*d* and bridge 54*c*.

In a non-limited example, the first rotation direction may be a clockwise or counter-clockwise direction.

The device 10 is assembled as follows.

The upper container 14 is filled with the second product B and the closing member 50 is screwed onto the dispensing chimney 24 until the plug 54 bears axially against the opened end 28 of said dispensing chimney 24.

The upper container 14 is fitted in a simple translation movement along the longitudinal axis X-X' on the lower container 12 which has been previously filled with the first product A, until the assembly skirt 30 of the upper container 14 snap-fasten onto the neck 18 of the lower container 12.

Figure 10:
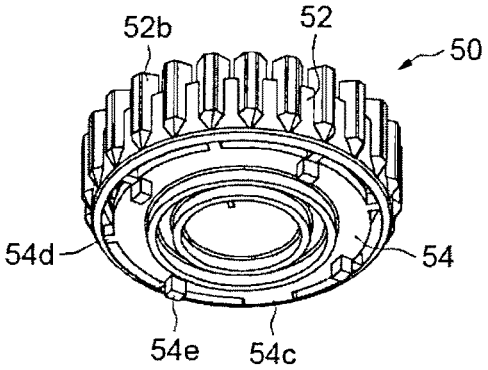
FIG. 10 is a perspective view of a closing member of the device of FIG. 1.
Figure 11:
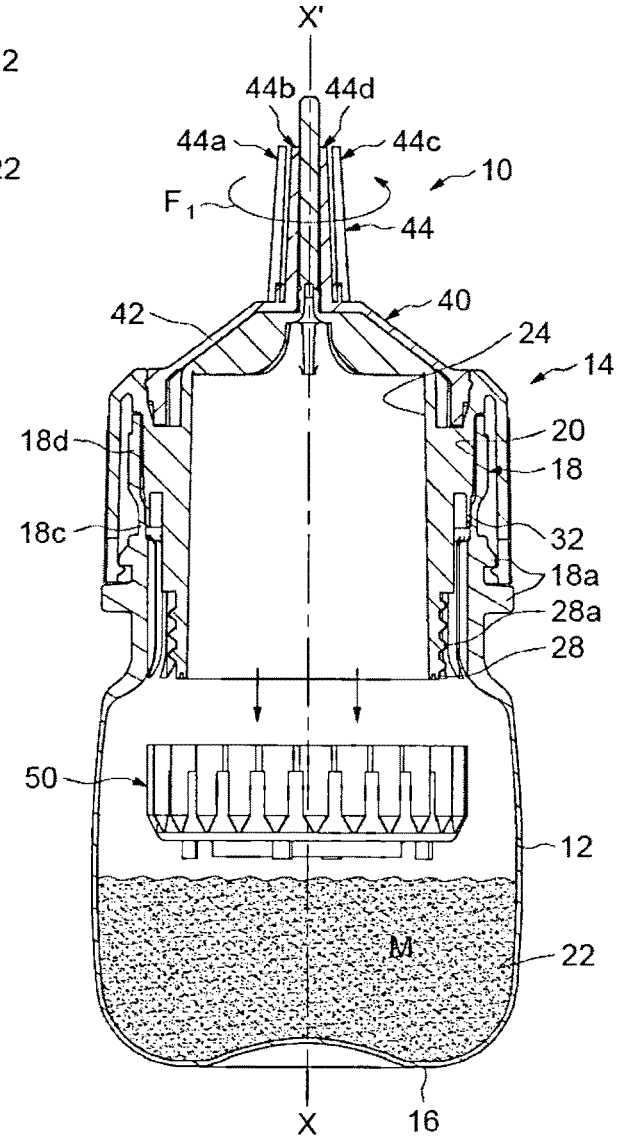
FIG. 11 shows the device of FIG. 1 in an opened position of an upper container after rotation of the upper container in a first rotation direction.

In order to put the inner volume 24*a* of the upper container 14 in flow communication with the inner volume 22 of the lower container 12 on first use of the device 10, the user turns the upper container 14 relative to the lower container 12 in a first rotation direction F1, as shown on FIG. 10, causing the closing member 50 to translate downwardly along the longitudinal axis X-X' compared to the lower container 12 until falling into the inner volume 22 of said lower container 12.

As illustrated on FIG. 10, and in a non-limited example, the first rotation direction F1 is a counter-clockwise direction. The first rotation direction could also be a clockwise direction.

In this embodiment, once the closing member 50 is in the inner volume 22 of the lower container 12, said closing member acts as a stirring member for the mixture M comprising the first and second products A, B by twist and shaking movements of the device 10.

The user then breaks the frangible dispensing closure 26 for using the device 10 and dispensing the resulting mixture M contained in the lower container 12 through the dispensing chimney 24 and the dispensing orifice 24*b*.

The lower container 12 may be processed with injection blow molding process. The lower container 12 is made for example in polymer material, such as thermoplastic material. The lower container 12 is, for example, injection molded onto a preform core consisting of the container neck with a thick tube of polymer material attached. The preform core has longitudinal outer ribs which will form the anti-rotation longitudinal ribs 18*e* provided on the inner circumferential surface of the neck 18 when compressed air is filled into the preform for inflating the thick tube into the bottle shape of the lower container.

The longitudinal anti-rotation ribs 18*e* are thus manufactured directly during injection blow molding process of the lower container 12.

Figure 12:
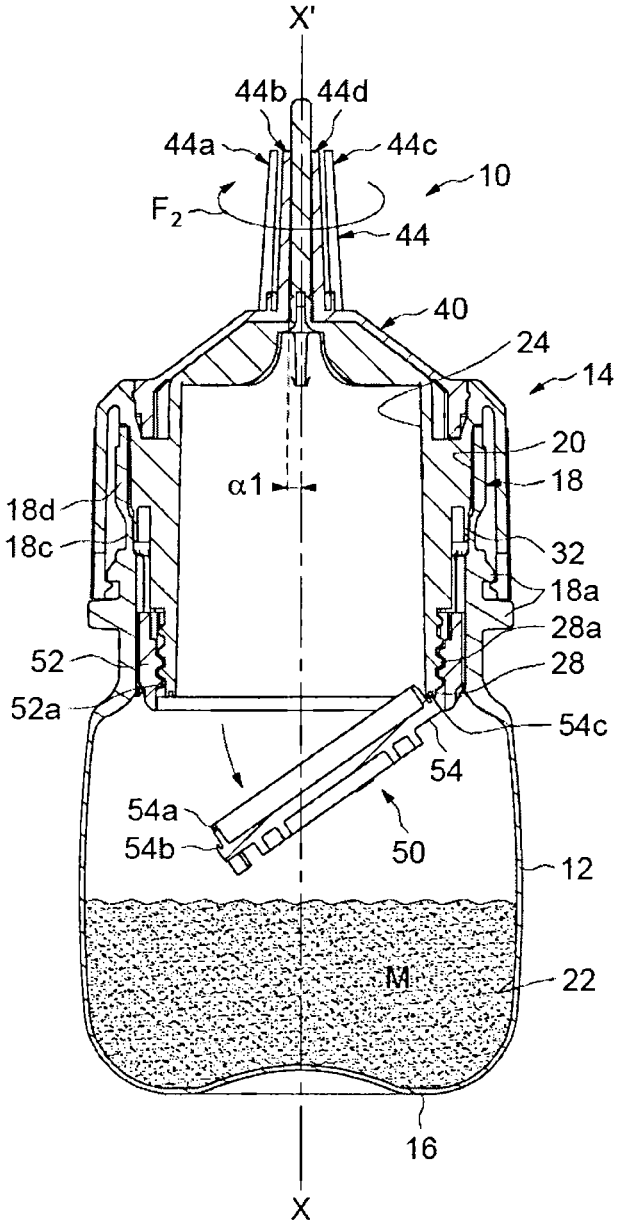
FIG. 12 is a cross section view of a device according to another embodiment of the present invention.

When the user rotates the upper container in a second rotation direction F2, as shown on FIG. 12, the closing member 50 translates upwardly until the breakable links 54*c* are broken by force causing the plug 54 to pivot around the bridge of hinge-forming material 54*b* and the second product B to flow towards the inner cavity 22 of the lower container 12.

As illustrated on FIG. 12, and in a non-limited example, the second rotation direction F2 is a clockwise direction. The second rotation direction F2 could also be a counter-clockwise direction as in FIG. 10.

The user further may rotate the upper container 14 in a rotation direction opposite to the second rotation direction F2, in order to translates the closing member 50 downwardly until falling into the inner cavity 22 of the lower container 12. (not shown on the Figures)

In this embodiment, the user may open the dispensing chimney 24 by rotating the upper container 14 in both rotation directions.

When using the device 10, in case the closing member 50 comes in front of the opened lower end 28 of the dispensing chimney 24, said closing member 50 will bear against said lower end 28 with its blocks 54*e*, thus allowing the mixture M contained in the lower container 12 to flow between the blocks 54*e* in the upper container 14 when turning said device 10 upside-down.

Figure 13:
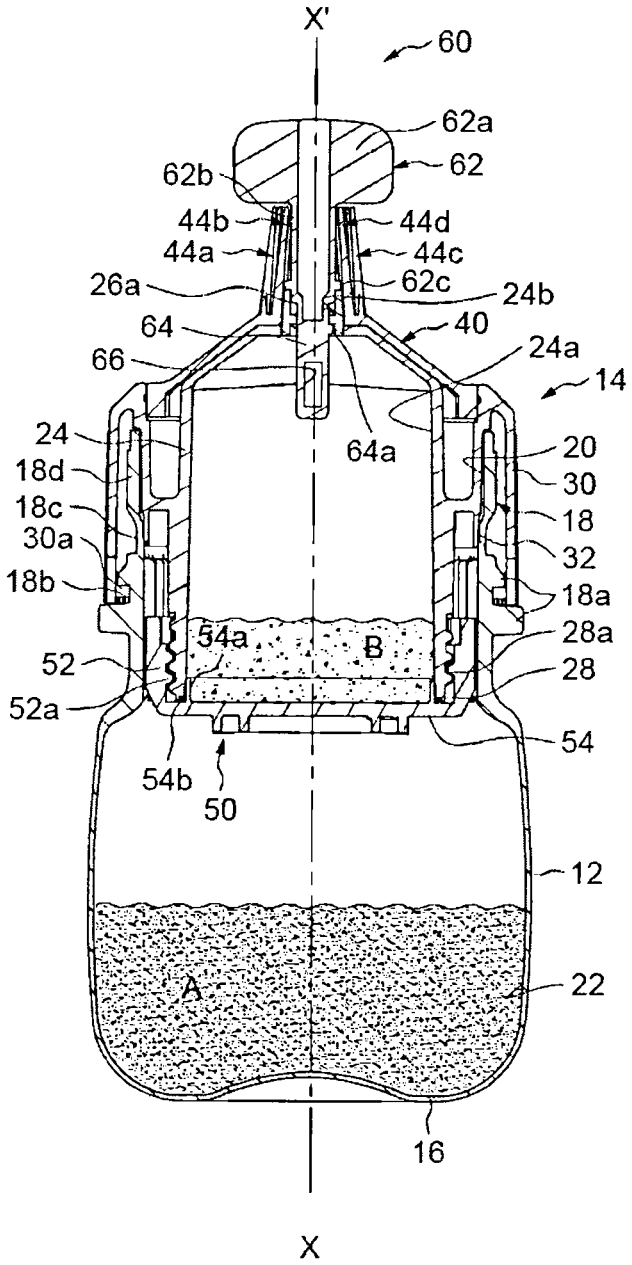
FIGS. 13 to 15 show different embodiments of the end closure of the device of FIG. 12.

The embodiment as shown on FIG. 13, in which the same elements bear the same references, differ from the embodiment of FIGS. 1 to 12 only by the shape of the dispensing closure.

As illustrated on FIG. 13, the dispensing closure 60 is configured to close the dispensing orifice 24*b* and comprises a handling element 62 having a griper 62*a* and a body 62*b* extending from the gripper 62*a*. As illustrated, the body 62*b* is tubular and is provided with a sealing annular flange 62*c* at an end opposite to the gripper 62*a*.

The dispensing closure 60 further comprises a closure member 64 suitable for closing the dispensing orifice 24*b* of the upper container 14. Said closure member 64 is tubular.

As illustrated on FIG. 13, the closure member 64 comprises a fastening element 64*a* designed to cooperate with a complementary fastening element provided on the inner surface of the dispensing orifice 24*b*. Fastening element 64*a* is here a quarter turn. Alternatively, any other fastening element may be used to temporarily secure the dispensing closure 60 in the dispensing orifice 24*b*, such as a screw thread, a clipping mechanism, etc.

The closure member 64 further comprises a through-hole 66 at a vicinity of its free end, opposite to the handling element 62.

The dispensing closure 60, and especially the through-hole 66 act as a collecting member for extracting a part of the product contained in the upper container 14, or the mixture M contained in the lower container 12. The user may then test said extracted part before using the whole product.

There is thus not need to add a distinct collecting member or to use a cotton swab to test the product before the first use.

Figure 14:
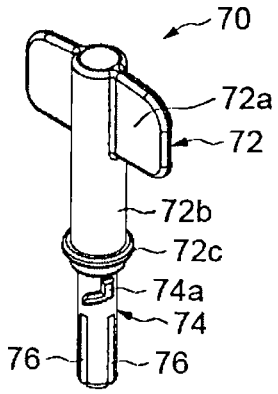

The embodiment as shown on FIG. 14, in which the same elements bear the same references, differ from the embodiment of FIG. 13 only by the shape of the collecting member of the dispensing closure.

As illustrated on FIG. 14, the dispensing closure 70 comprises a handling element 72 having a griper 72*a* and a body 72*b* extending from the gripper 72*a*. As illustrated, the body 72*b* is tubular and is provided with a sealing annular flange 72*c* at an end opposite to the gripper 72*a*.

The dispensing closure 70 further comprises a closure member 74 suitable for closing the dispensing orifice 24*b* of the upper container 14. Said closure member 74 is tubular.

As illustrated on FIG. 14, the closure member 74 comprises a fastening element 74*a* designed to cooperate with a complementary fastening element provided on the inner surface of the dispensing orifice 24*b*. Fastening element 74*a* is here a screw thread of a quarter turn. Alternatively, any other fastening element may be used to temporarily secure the dispensing closure 70 in the dispensing orifice 24*b*.

The closure member 74 further comprises at its free end, opposite the handling element 72, a collecting member 76 comprising a plurality of axial grooves 76*a* regularly spaced apart circumferentially.

The dispensing closure 70, and especially the grooves 76*a* act as for extracting a part of the product contained in the upper container 14, or the mixture M contained in the lower container 12. The user may then test said extracted part before using the whole product.

There is thus not need to add a distinct collecting member or to use a cotton swab to test the product before the first use.

Figure 15:
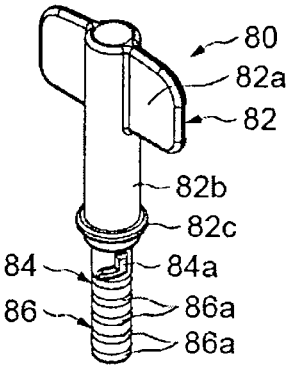

The embodiment as shown on FIG. 15, in which the same elements bear the same references, differ from the embodiment of FIG. 14 only by the shape of the collecting or sampling member of the dispensing closure.

As illustrated on FIG. 15, the dispensing closure 80 comprises a handling element 82 having a griper 82*a* and a body 82*b* extending from the gripper 82*a*. As illustrated, the body 82*b* is tubular and is provided with a sealing annular flange 82*c* at an end opposite to the gripper 82*a*.

The dispensing closure 80 further comprises a closure member 84 suitable for closing the dispensing orifice 24*b* of the upper container 14. Said closure member 84 is tubular.

As illustrated on FIG. 15, the closure member 84 comprises a fastening element 84*a* designed to cooperate with a complementary fastening element provided on the inner surface of the dispensing orifice 24*b*. Fastening element 84*a* is here a screw thread of a quarter turn. Alternatively, any other fastening element may be used to temporarily secure the dispensing closure 80 in the dispensing orifice 24*b*.

The closure member 84 further comprises at its free end, opposite the handling element 82, a collecting member 86 comprising a plurality of radial grooves 86*a* regularly spaced apart axially.

The dispensing closure 80, and especially the grooves 86*a* act as for extracting a part of the product contained in the upper container 14, or the mixture M contained in the lower container 12. The user may then test said extracted part before using the whole product.

There is thus not need to add a distinct collecting member or to use a cotton swab to test the product before the first use.

Thanks to the device according to the present invention, it is possible to provide a device for packaging two separate products of simple structure, easy to manufacture and providing good retention and distribution of the product on a surface.

The invention claimed is:

1. Device (10) for packaging at least one product and dispensing at least said product (B) on a surface and comprising at least one container (14) delimiting a product cavity (24*a*) containing said at least one product and having a dispensing closure (26) designed to be separated from the container (14) for first use of said device in order to open a first dispensing orifice (24*b*) in flow communication with the product cavity (24*a*), characterized in that:

said device comprises an application member (40) mounted on the at least one container (14) having at least two rows (44*b*, 44*d*) of elastically deformable application teeth (44) arranged on both side of the dispensing closure (26) and extending outwardly from said at least one container (14), said application teeth (44) being each inclined towards the longitudinal axis (X-X') of the first dispensing orifice (24*b*), and wherein during transport and before the first use, when the dispensing closure (26) is located between the teeth (44), at least a plurality of teeth of the said rows (44*b*, 44*d*) of teeth are stressed mechanically in a first stressed position in which the teeth (44) are in contact with the dispensing closure (26) and form a first angle ($\alpha$1) with the longitudinal axis (X-X'), and configured to flex automatically elastically in a second rest position when the dispensing closure (26) is removed, in said second rest position, the teeth form a second angle ($\alpha$2) with the longitudinal axis (X-X'), the second angle being bigger than the first angle are more inclined towards the longitudinal axis (X-X') of the first dispensing orifice (24*b*) than in the first stressed position, and wherein in the second rest position, the free end of the teeth of the second and said rows (44*b*, 44*d*) of teeth are located in the flow path of the product to be dispensed.

2. Device (10) according to claim 1, wherein the application teeth (44) extend transversally beyond the first dispensing orifice (24*b*).

3. Device (10) according to claim 1, wherein the teeth have the shape of a straight rod.

4. Device (10) according to claim 1, wherein the free end of the teeth (44) are not in contact in the second rest position.

5. Device (10) according to claim 1, wherein the application member (40) comprises a cover (42) having an opening (42*a*) for the dispensing closure (26).

6. Device according to claim 5, wherein each tooth (44) has a base section connected to the cover (42) and a free end opposite to the base section and wherein each tooth (44) is capable of flexing around the junction with its base section and the cover (42).

7. Device according to claim 1, wherein the application member (40) comprises four rows (44*a*, 44*b*, 44*c*, 44*d*) of teeth (44) arranged two by two on each side of the dispensing closure (26).

8. Device according to claim 7, wherein the rows (44*a*, 44*b*, 44*c*, 44*d*) of teeth (44) are parallel to each other.

9. Device according to claim 7, wherein the teeth (44) of two adjacent rows of teeth (44*a*, 44*b*; 44*c*, 44*d*) are in a staggered arrangement.

10. Device according to claim 1, wherein each tooth (44) has a triangular cross section, which may decrease continuously, on at least a part of its length, towards its free end.

11. Device (10) according to claim 1, wherein the end of the container (14) is provided with notches (26*a*) in order to easily separate the dispensing closure (26) from said container (14).

12. Device (10) according to claim 11, wherein the notches (26*a*) are be located circumferentially around the end of the container (14) and spaced apart from each other.

13. Device (10) according to claim 11, wherein an upper part of the container (14) comprises a duct (24) having an upper portion with the dispensing closure (26), wherein the dispensing closure (26) comprises a plug opposite to the notches (26*a*) designed to be inserted in the dispensing orifice (24*b*) after the dispensing closure (26) is broke off from the duct (24).

14. Device (10) according to claim 1, comprising a second container (12) delimiting a second product cavity (22) containing a second product (A) and separated from the first product cavity (4*a*), said containers (12, 14) being capable of rotating one relative to the other without moving axially.

15. Device (10) according to claim 14, wherein said device (10) further comprises a temporary closing member (50) configured to close an opened end (28) of the upper container (14) before the first use, and comprising a cylindrical skirt (52) surrounding said opened end (28) and a plug (54) connected to said cylindrical skirt (52), said cylindrical skirt (52) being provided, on its inner cylindrical surface, with inner threads (52*a*) cooperating with outer threads (28*a*) provided on the upper container (14) and on its outer cylindrical surface, with first anti-rotation means (52*b*) cooperating with second anti-rotation means (18*e*) provided on the lower container (12) for preventing rotation between the closing member (50) and the lower container (12), the closing member (50) being deprived from any axially retaining members with both containers (12, 14), such that when the upper container (14) is rotated in a first rotation direction (F1), the closing member translates downwardly until falling into the first product cavity (22).

* * * * *